US005098488A

United States Patent [19]

Hassell et al.

[11] Patent Number: 5,098,488

[45] Date of Patent: Mar. 24, 1992

[54] COMPOSITION

[75] Inventors: Cecil D. Hassell, Street, Md.; Lawrence A. Bickford, New Park, Pa.; Sandra D. Smith, Edgewood, Md.; Gartung Cheng, Edison, N.J.; Gene V. Tracy, Bel Air, Md.

[73] Assignee: The United States of America as represented by the Secretary of the Army, Washington, D.C.

[21] Appl. No.: 671,605

[22] Filed: Mar. 19, 1991

[51] Int. Cl.[5] ..... C06B 45/10

[52] U.S. Cl. ..... 149/19.6; 252/305

[58] Field of Search ..... 149/19.6; 252/305; 102/334

[56] References Cited

U.S. PATENT DOCUMENTS

| | | | |
|---|---|---|---|
| 4,405,762 | 9/1983 | Earl et al. | 525/410 |
| 4,915,755 | 4/1990 | Kim | 149/19.4 |
| 4,919,737 | 4/1990 | Biddle et al. | 149/19.5 |
| 4,976,794 | 12/1990 | Biddle et al. | 149/19.5 |
| 5,049,214 | 9/1991 | Hassel et al. | 149/109.4 |

*Primary Examiner*—Richard D. Lovering
*Assistant Examiner*—N. Bhat
*Attorney, Agent, or Firm*—Anthony T. Lane; Edward Goldberg; Edward F. Costigan

[57] ABSTRACT

A mixture containing 3,3-bis(aziodomethyloxetane) and terephthalic acid for use as a white cloud producing composition which may be used by the military for screening field operations.

4 Claims, No Drawings

COMPOSITION

The invention described herein may be manufactured, used, and licensed by or for the Government for governmental purposes without the payment to us of any royalty thereon.

FIELD OF USE

This invention relates to a pyrotechnic composition which produces a white smoke for use in military screening operations.

BACKGROUND OF THE INVENTION

Due to the fact that pyrotechnics are dangerous, they must be handled with due care, particularly for safety sake. What complicates the problem is that the standard pyrotechnic composition contains a multitude of ingredients, such as fuel, an oxidizer, a coolant, a wetting agent, and a filler.

During manufacture, each of the aforesaid ingredients must be added to each other in a very rigid procedure, and in precise amounts. If this procedure is not carried out in the prescribed manner, there is danger of a hazardous condition which may come into play which could result in a conflagration, fire or even an explosion.

Further, if the ingredients are not incorporated into the composition in the correct amounts, the composition will not function in the correct manner to produce the desired amount of white screening smoke, or may even malfunction or explode.

With evidence of the above arguments and facts in our mind, we have invented a composition which consists of no more than two components or ingredients. This composition functions in the precise manner to produce a white cloud of screening smoke which is less hazardous to control in manufacture.

DESCRIPTION OF THE INVENTION

The composition we have invented is merely a mixture of an energetic material named 3,3-bis(azidomethyloxetane) and a chemical called terephthalic acid which produces a white cloud of screening smoke.

The range of the energetic material in the composition is between 35 to 65 percent by weight with the remainder being the cited smoke-producing material for a total of 100 percent by weight which represents the entire composition. If the amount of the energetic material is below 35 percent by weight, the mixture will fail to ignite due to lack of energy. On the other hand, if the amount of smoke-producing material is present below 35 percent by weight, the latter yield of white cloud of screening smoke will fall below acceptable limits. With either ingredients above 35 percent by weight, the other ingredient is present in an amount which will total 100 percent by weight in any combination for the total composition.

Experiments were carried out with an equal weight of both components of the mixture, i.e., 50 percent by weight for each ingredient. However, such mixtures, although acceptable in functions, were not the best in terms of yield of smoke as a screening cloud for military operations.

Based on experience, the best composition contained about 40 percent by weight of the energetic material and 60 percent by weight of the smoke-producing material.

PROCEDURE OF MAKING

The energetic material and the smoke-producing material are oven-dried at 125 degrees F. Each of the cited components are then pushed through a no. 16 sieve screen to assure particle size less than 1.19 mm in size. The two components are then mixed together, while drying, in a suitable container with a spatula until homogeneous.

RESULTS

The resulting mixture is a smooth burning pyrotechnic that can be disseminated at will, in large yields of smoke as a screening cloud, into the atmosphere to provide a superior atmosphere for cover of military operations.

The above cool burning mixture produces no toxic gases. It is uniquely suitable for use by the military in smoke systems, such as M8 smoke grenades.

The cited pyrotechnic mixture produces high yields of air-borne smoke in operations, and less of a chance of producing a hazard to the personnel using such mixture in the laboratory, plant, or in the field.

FIELD OF USE

The mixture has application in both military and law enforcement operations and may be distributed through systems, such as M8 smoke grenades.

It will be apparent to those of ordinary skill in this art that various changes and modifications may be made therein without departing from the scope and spirit of the invention.

What is claimed is:

1. A white cloud smoke producible mixture of 3,3-bis-(azidomethyloxetane) which is an energizer and terephthalic acid.

2. A smoke producing mixture of claim 1 in which said energizer is present in amount of between about 35 and about 65 percent by weight, and the remainder of a total weight being between about 35 and about 65 percent by weight of terephthalic acid.

3. The smoke producing mixture of claim 1 in which said energizer is present in amount of about 40 percent by weight and said terephthalic acid is present in the amount of about 60 percent by weight.

4. The smoke producing mixture of claim 1 in which said energizer is present in amount of about 50 percent by weight and said terephthalic acid is present in the amount of about 50 percent by weight.

* * * * *